United States Patent [19]

Hruda

[11] 3,950,628

[45] Apr. 13, 1976

[54] BELLOWS-TYPE SHORTING SWITCH

[75] Inventor: Robert M. Hruda, Horseheads, N.Y.

[73] Assignee: Westinghouse Electric Corporation, Pittsburgh, Pa.

[22] Filed: Oct. 10, 1974

[21] Appl. No.: 513,788

[52] U.S. Cl. ..... 200/302; 200/83 C; 200/144 B

[51] Int. Cl.[2] ..... H01H 35/32

[58] Field of Search ..... 92/41; 200/239, 289, 293, 200/302, 83 C, 83 Y, 83 D, 144 B

[56] References Cited

UNITED STATES PATENTS

| | | | |
|---|---|---|---|
| 2,724,030 | 11/1955 | Hilgert | 200/302 |
| 2,943,167 | 6/1960 | Hughes | 200/83 D |
| 3,087,034 | 4/1963 | Beers | 200/144 B |
| 3,182,156 | 5/1965 | Lee | 200/144 B |
| 3,246,979 | 4/1966 | Lafferty | 200/144 B |

FOREIGN PATENTS OR APPLICATIONS

| | | | |
|---|---|---|---|
| 1,204,458 | 9/1970 | United Kingdom | 200/144 B |
| 1,218,583 | 6/1966 | Germany | 200/144 B |

*Primary Examiner*—Gerald P. Tolin
*Attorney, Agent, or Firm*—W. G. Sutcliff

[57] ABSTRACT

A high current shorting switch wherein relatively movable contacts are surrounded by a flexible bellows which forms a hermetically sealed chamber, within which the contacts are disposed. The contacts are supported on heavy current carrying supports which terminate in two large end plates. Insulated holes are formed in one of the end plates which engage rods extending from the other plate to provide guidance for relative movement of the two end plates. An annular ring is disposed within the flexible bellows to prevent or limit current flow through the flexible bellows. The flexible bellows are coated with a protective coating which substantially increase the life of the bellows. The contact surfaces are preferably formed from a material having good weld break characteristics, such as copper bismuth while the contact supports and the end plates are formed from a material which is a good electrical conductor, such as copper. The high current, low voltage shorting switch is particularly adaptable for use in service with electrochemical cell switching for handling voltages of around 5 volts and current up to 5,000 amperes, singly. In combination a plurality of the disclosed shorting switches can carry any desired current.

5 Claims, 1 Drawing Figure

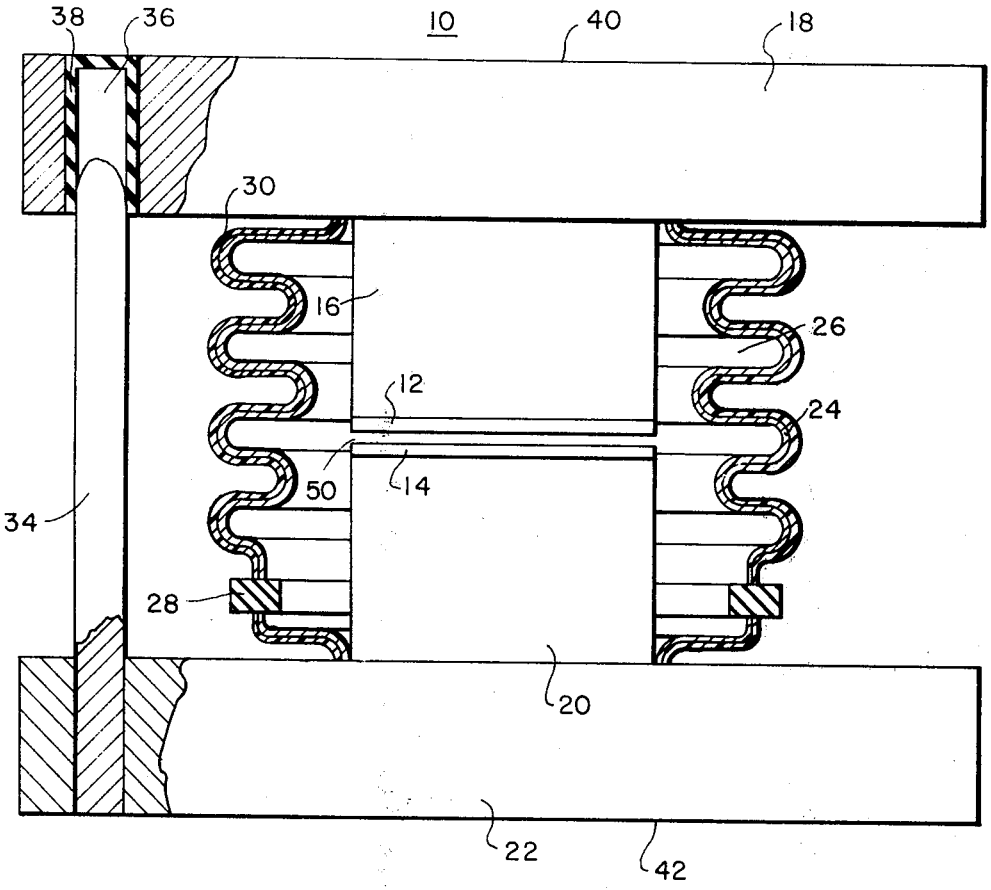
38
36
10
40
18
30
16
26
12
24
50
14
34
28
20
22
42

BELLOWS-TYPE SHORTING SWITCH

BACKGROUND OF THE INVENTION

1. Field of the Invention

The disclosed invention relates to low voltage, high current shorting switches and more particularly to a construction of a high current short circuiting device which is particularly adaptable for use in electrolytic installations with voltages on the order of 5 volts and amperage up to 5,000 amps each.

2. Description of the Prior Art

High current, low voltage DC shorting switches are used in electrolytic cell installations to switch out defective cells. The high current low voltage switches are designed as short-circuiting devices for electrolytic applications with voltages of the bath up to 5 volts and bath amperages up to 200,000 amps. Prior art high current, low voltage shorting switches for electrolytic installations have not been hermetically sealed; and, the shorting switch contacts have been subject to attack in the corrosive atmosphere. This presents problems and has necessitated excessive maintenance and care of the shorting switch contacts.

SUMMARY OF THE INVENTION

A low voltage high current hermetically sealed shorting switch is provided. The switch is primarily intended for use for DC shorting of electrolytic cell installations to switch out defective cells. The voltages under consideration are normally very low, in the order of 5 volts DC, and the normal operating currents, of each switch, are very high usually up to 5,000 amperes DC. In combination the switches can carry any desired current.

A pair of contacts, preferably formed from copper bismuth, are disposed within an elongated flexible bellows which forms a seal with portions of the shorting switch to enclose the contacts in a hermetically sealed environment. If the bellows are formed from a metallic material, an insulating ring, preferably of ceramic material, can be disposed within a portion of the bellows to prevent a longitudinal current path through the bellows. The outside surface of the bellows is protected from the environment by an elastic protective coating, such as silicon rubber, or teflon. This protects the bellows from being attacked in the sealed environment and provides for much longer bellows life.

The contacts are supported by a pair of heavy current carrying supports which extend from a pair of thick flat end plates. Thus, each contact support has one end connected to a heavy current carrying capacity end plate and the other end supports a contact. Relative movement of the end plates is provided for by flexing of the bellows. The exposed side of the end plates presents a flat surface without any protruding members, to facilitate attachment to heavy current carrying members such as bus bars.

Alignment means extends between the end plates for maintaining relative alignment of the pair of end plates. A plurality of pins which extend from one end plate and engage insulating openings in the other end plate can be used for aligning the end plates. The disclosed shorting switch which presents a low profile, has large flat contact areas formed on the outside facing surfaces of both end plates, thus providing for secure connection to large current carrying members such as flat bus bars. It would be difficult to obtain the required high current carrying capacity without making secure contact to a relatively large flat surface.

The object of this invention is to disclose a low voltage high current DC shorting switch having a low profile wherein the length of the end plates, perpendicular to the axis of the contact supports, is greater than the separation of the end plates.

A further object of this invention is to disclose a low voltage high current, shorting switch in which a flexible bellows forms the outer housing; thus permitting relative movement of the large current carrying end plates. The bellows also provide a hermetically sealed environment for the contacts.

BRIEF DESCRIPTION OF THE DRAWING

For a better understanding of the invention reference may be had to the preferred embodiment exemplary of the invention shown in the accompanying drawing, in which:

FIG. 1 is a low voltage high current shorting switch utilizing the teaching of the present invention.

DESCRIPTION OF THE PREFERRED EMBODIMENTS

Referring now to FIG. 1, there is shown a low voltage, high current shorting switch utilizing the teaching of the present invention. The shorting switch 10 has two contacts, 12 and 14, which are relatively movable between an open position, spaced slightly apart, and a closed position in engagement. The contacts 12 and 14 are preferably formed from material having good weld breaking characteristics, such as copper bismuth. Contacts 12 is supported at the end of a support rod 16 which is formed of a good conductor, such as copper. Support rod 16 is attached to and extends from end plate 18. Contact 14 is attached to the free end of support rod 20, which extends from end plate 22. Support rods 16 and 20 are attached to their associated end plates 18 and 22 respectively by suitable means, such as welding or brazing, to make a good electrical connections thereto. Flexible bellows 24 is disposed around the contacts 12 and 14 and sealed to the support rods 16 and 20 or the end plates 18 and 22 to provide a sealed chamber 26 for the contacts 12 and 14. The sealed chamber 26 does not communicate with the atmosphere surrounding the switch 10, which may be corrosive. The gas chamber 26 can be evacuated or filled with a dielectric fluid such as nitrogen. By disposing the contacts 12 and 14 in a sealed environment they are prevented from being attacked by corrosive chemicals which may be present in the surrounding atmosphere. Isolating the contacts from the surrounding environment lengthens the contact life and reduces maintenance of the shorting switch.

The bellows 24 is formed from a conductive metal. An insulating ring 28 is disposed, as a part of the bellows, to prevent a current path, from end plate 18 to end plate 22, through the bellows. The annular insulating ring 28, disposed within the bellows 24, is preferably formed from a material having good dielectric strength to which the bellows can easily be bonded, such as a ceramic. The bellows 24 is coated with an elastic protective coating 30, such as silicon rubber or teflon. This coating prevents the bellows from being attacked by a corrosive atmosphere, and also protect the bellows 24 from exposure to oxygen, present in a normal atmosphere; either of which condition can shorten the life of the bellows 24. Thus, the protective coating 30 improves the life of the bellows 24 in a normal atmosphere or a corrosive atmosphere. Flexible bellows 24 permits relative movement of either end plates 18 or 22.

End plates 18 and 22 are formed from a material having good electrical conductivity such as copper. End plates 18 or 22 have a large flat outward facing surface to which massive conductors can easily be connected. That is, no part of the shorting switch protrudes through the flat surfaces 40 and 42, provided on end plates 18 and 22, respectively. End plates 18 and 22 can be of any desired shape, such as square or circular. The end plates 18 and 22 must have a large enough flat surface, to which current carrying members can be connected, to allow for high current operation without excessive heating. Likewise, the cross-sectional area of the end plates 18 and 22 must have sufficient capacity to easily carry the required current and act as a heat sink for heat generated due to current flow through contact supports 16 and 20 and contacts 12 and 14, when shorting. The separation between end plates 18 and 22 is kept small and this provdes for good heat dissipation from heat generated by current flow through the shorting switch 10. The large flat surfaces 40 and 42 provide for good contact areas for making connection to large current carrying members, such as bus bars.

A plurality of alignment means 34 extend from end plate 22 and engage opening 36 in the other end plate 18. This provides for relative alignment of the end plates 18 and 22. If alignment pins 34 are formed from a conductive material insulating means must be provided to prevent current flow between the end plates 18 and 22 through conductive pin 34. The insulation can be an insert 38 which is formed of insulating material to insulate end cap 18 from end cap 22.

The low profile of the shorting switch 10, wherein the longitudinal axis is shorter than the cross section axis is advantageous for heat dissipation. The low profile also makes the disclosed shorting switch 10 easily adaptable for installation into existing electrolytic cell applications. The connection to large bus bars is simplified by the large flat surfaces 40 and 42. Since this switch is intended to operate at only low voltages the gap 50 formed between contact 12 and 14 when in the open position can be as small as practical. That is, only the minimum obtainable gap need be present between contacts 12 and 14.

Thus, it can be seen that the disclosed shorting switch 10, which is particularly adaptable for electrolytic cell shorting, has a low profile providing for good heat dissipation and easy attachment to existing large current carrying bus members. The flat surfaces 40 and 42, having no protrusions therefrom, provides for easy connection to large current carrying members. The hermetically sealed chamber, wherein contacts 12 and 14 are disposed, provides for long contact life and reliable service even in a corrosive atmosphere. The protective coating on the bellows 14 provides for long bellows life even under severe operating conditions in a corrosive atmosphere.

I claim:

1. A normally open, low voltage shorting switch comprising:

first and second conductive end plates spaced apart in parallel orientation, with axially aligned connecting portions extending from the spaced surface of the first and second conductive end plates, with the free end portions of the connecting portions spaced apart;

electrical contacts disposed on the free end portions of the respective connecting portions, which electrical contacts are spaced apart;

a flexible bellows about the electrical contacts with opposed ends of the bellows hermetically sealed to portions of the first and second conductive end plates, which bellows means includes a metal portion and an annular ceramic ring portion sealed thereto intermediate the bellows ends which prevents a continuous conducting path through the flexible bellows;

guide means comprising a plurality of rods extending from the first conductive end plate, and including aligned rod receiving openings in the second end plate receiving the respective rods, so that when compressive force is applied between the first and second conductive end plates the bellows will be compressed and the electrical contacts will be axially moved together to a closed electrical contact position.

2. The normally open, low voltage shorting switch specified in claim 1, wherein the electrical contacts comprise copper bismuth.

3. The normally open, low voltage shorting switch specified in claim 1, wherein the volume within the hermetically sealed flexible bellows is evacuated.

4. The normally open, low voltage shorting switch specified in claim 1, wherein the volume within the hermetically sealed flexible bellows is filled with insulating gas.

5. The normally open, low voltage shorting switch specified in claim 1, wherein the exterior of the metal portions of the flexible bellows has an elastic protective coating thereon.

* * * * *